US008888098B2

(12) United States Patent
Kogure et al.

(10) Patent No.: US 8,888,098 B2
(45) Date of Patent: Nov. 18, 2014

(54) BALL LOTTERY APPARATUS

(75) Inventors: Shoki Kogure, Minato-ku (JP); Taisuke Sazaki, Minato-ku (JP)

(73) Assignee: Konami Gaming, Inc., Las Vegas, NV (US)

( * ) Notice: Subject to any disclaimer, the term of this patent is extended or adjusted under 35 U.S.C. 154(b) by 45 days.

(21) Appl. No.: 13/813,473

(22) PCT Filed: Aug. 30, 2011

(86) PCT No.: PCT/JP2011/069523

§ 371 (c)(1),
(2), (4) Date: Jan. 31, 2013

(87) PCT Pub. No.: WO2012/029741

PCT Pub. Date: Mar. 8, 2012

(65) Prior Publication Data

US 2013/0127112 A1 May 23, 2013

(30) Foreign Application Priority Data

Sep. 1, 2010 (JP) ..... 2010-195661

(51) Int. Cl.

| | |
|---|---|
| ***A63F 5/02*** | (2006.01) |
| ***A63F 5/00*** | (2006.01) |
| ***G07C 15/00*** | (2006.01) |
| *A63F 7/34* | (2006.01) |

(52) U.S. Cl.

CPC ..... *A63F 5/007* (2013.01); *A63F 5/0076* (2013.01); *A63F 5/0088* (2013.01); *A63F 5/00* (2013.01); *A63F 2007/345* (2013.01); *G07C 15/001* (2013.01)

USPC ..... 273/142 E; 273/274; 273/138.1; 273/138.2

(58) Field of Classification Search

CPC ..... A63F 5/0005; A63F 5/007; A63F 5/0076; A63F 5/0088; A63F 5/02; A63F 5/048

USPC ..... 273/142 E, 274, 138.1, 138.2

See application file for complete search history.

(56) References Cited

U.S. PATENT DOCUMENTS 7,674,172 B2 * 3/2010 Miltenberger et al. ..... 463/17
2005/0159205 A1 7/2005 Kukita (Continued)

FOREIGN PATENT DOCUMENTS

CN 201197878 Y 2/2009
EP 1 627 670 A3 10/2007

(Continued)

OTHER PUBLICATIONS

Japanese Office Action for JP 2010-195661 dated Nov. 29, 2011.

(Continued)

*Primary Examiner* — Benjamin Layno
(74) *Attorney, Agent, or Firm* — Sughrue Mion, PLLC

(57) ABSTRACT

A ball lottery apparatus includes a roulette section having a roulette wheel and a retention plate that are superposed and rotatable as a unit, a slide motor unit for changing the relative position of the retention plate with respect to the roulette wheel, and a host controller for selecting either of a ball-hold mode or a ball-through mode for the roulette section. In the ball-hold mode, the host controller controls the slide motor unit so that the roulette section retains the balls. In the ball-through mode, the host controller controls the slide motor unit so that the balls fall down from the roulette section.

8 Claims, 11 Drawing Sheets

(56) References Cited

U.S. PATENT DOCUMENTS

| | | | | |
|---|---|---|---|---|
| 2006/0046837 | A1 | 3/2006 | Ito et al. | |
| 2007/0075488 | A1* | 4/2007 | Pececnik | 273/138.1 |

FOREIGN PATENT DOCUMENTS

| | | | |
|---|---|---|---|
| JP | 3-24179 | U | 3/1991 |
| JP | 0730044 | Y2 | 3/1991 |
| JP | 9-140857 | A | 6/1997 |
| JP | 2003-842 | A | 1/2003 |
| JP | 2003-117088 | A | 4/2003 |
| JP | 2004-89514 | A | 3/2004 |
| JP | 2004-236834 | A | 8/2004 |
| JP | 2004-236838 | A | 8/2004 |
| JP | 2005-192605 | A | 7/2005 |
| JP | 2010-94325 | A | 4/2010 |
| JP | 4529317 | B2 | 8/2010 |

OTHER PUBLICATIONS

International Search Report for PCT/JP2011/069523 dated Dec. 6, 2011.

Chinese Office Action issued in Chinese Patent Application No. 201180042228.1 dated Apr. 18, 2014.

* cited by examiner

FIG. 10

| POCKET NUMBER | BALL NUMBER | NUMBER OF POCKETS TO ANOTHER BALL THAT IS THREE BALLS AHEAD | FIRST STATUS | SECOND STATUS | THIRD STATUS | FOURTH STATUS | FIFTH STATUS | SIXTH STATUS |
|---|---|---|---|---|---|---|---|---|
| P1 | | | SECOND AREA | SECOND AREA | SECOND AREA THREE BALLS | BOUNDARY | FIRST AREA | FIRST AREA FOUR BALLS |
| P2 | | | | | | SECOND AREA THREE BALLS | | |
| P3 | (1) | 12 | FIRST AREA FOUR BALLS | | | | | |
| P4 | | | | | | | | |
| P5 | (2) | 16 | | FIRST AREA THREE BALLS | | | SECOND AREA TWO BALLS | |
| P6 | | | | | | | | |
| P7 | | | | | | | | |
| P8 | | | | | | | | |
| P9 | (3) | 15 | | | FIRST AREA THREE BALLS | | | SECOND AREA TWO BALLS |
| P10 | | | | | | | | |
| P11 | | | | | | | | |
| P12 | | | | | | | | |
| P13 | | | | | | | | |
| P14 | (4) | 15 | | | | FIRST AREA THREE BALLS | | |
| P15 | | | BOUNDARY | | | | | |
| P16 | | | SECOND AREA TWO BALLS | | | | | |
| P17 | | | | BOUNDARY | | | | |
| P18 | | | | SECOND AREA THREE BALLS | | | | |
| P19 | | | | | | | BOUNDARY | |
| P20 | (5) | 11 | | | | | FIRST AREA FOUR BALLS | |
| P21 | | | | | BOUNDARY | | | |
| P22 | | | | | SECOND AREA | | | BOUNDARY |
| P23 | (6) | 12 | | | | | | FIRST AREA |
| P24 | | | | | | | | |
| P25 | | | | | | | | |

BALL LOTTERY APPARATUS

FIELD OF THE INVENTION

The present invention relates to a ball lottery apparatus for offering a drawing by the use of multiple lottery balls.

BACKGROUND ART

For example, Patent Document 1 discloses a lottery apparatus including a field on which input lottery balls roll, and a roulette section having multiple pockets into which the lottery balls may drop. When the ball lottery apparatus offers a drawing, the multiple lottery balls are input to the field, and the lottery result is decided depending on which pockets the input lottery balls enter.

Patent Document 1: JP-A-2004-89514

SUMMARY OF THE INVENTION

In the above-described lottery apparatus, once a lottery is finished, the lottery balls having entered the pockets are retrieved, and then the retrieved lottery balls are input to the field again for the next lottery.

However, Patent Document 1 does not disclose a mechanism for retaining balls, which have entered the pockets, in the pockets. If the balls that have entered the pockets cannot be retained in the pockets and promptly fall in the retrieval mechanism, players may not be able to confirm which pockets the balls entered. However, if the balls retained in pockets are individually retrieved, the apparatus may be complicated.

The present invention provides a ball lottery apparatus with a simple structure in which lottery balls that have entered the pockets can be retained and then retrieved.

According to the present invention, a ball lottery apparatus includes a roulette section including a roulette wheel having multiple lottery pockets through which lottery balls can pass, the lottery pockets being arranged along a circumferential direction, and a retention plate located below the roulette wheel, comprising multiple retaining members configured to coincide with the lottery pockets, respectively, for retaining the lottery balls that have entered the lottery pockets without falling, and spaces interposed between neighboring retaining members, the lottery balls being capable of passing through the spaces, the roulette wheel and the retaining members are configured to be rotated as a unit; a driver configured to change a relative position of the retention plate with respect to the roulette wheel; and a mode selector adapted for selecting either of a first mode or a second mode for the roulette section, wherein in case in which the mode selector has selected the first mode, the driver sets the position of the retention plate with respect to the roulette wheel so that the retaining members of the retention plate and the lottery pockets of the roulette wheel are superposed, whereby lottery balls that have entered the lottery pockets are retained by the retaining members below the lottery pockets, and wherein in case in which the mode selector has selected the second mode, the driver sets the position of the retention plate with respect to the roulette wheel so that the spaces between the retaining members of the retention plate and the lottery pockets of the roulette wheel are superposed, whereby lottery balls that have entered the lottery pockets fall through the spaces below the lottery pockets. In the roulette section, the roulette wheel located above, whereas the retention plate is located below.

For example, whereas the roulette section may be set to the first mode when a lottery is offered with the use of balls, the roulette section may be set to the second mode when the lottery balls are retrieved after completion of the lottery. The lottery result is decided depending on which pockets the multiple lottery balls used in the lottery have entered. In the first mode, because the roulette section retains the balls, players can easily confirm which pockets the balls have entered. After completion of the lottery, in order to retrieve the lottery balls, the driver sets the position of the retention plate with respect to the roulette wheel so that the spaces interposed between neighboring retaining members of the retention plate are positioned below the lottery pockets of the roulette wheel, whereby lottery balls that have entered the lottery pockets fall through spaces below the lottery pockets. Therefore, all of the lottery balls having entered the lottery pockets fall at the same time and are retrieved. In other words, the present invention with a simple structure using a sole driver has an advantage in that multiple lottery balls entering the lottery pockets can be retrieved at the same time.

The shape of the retention plate may be freely chosen. For example, multiple holes through which the lottery balls can pass may be formed as the spaces at the retention plate, and may be arranged along a circumferential direction, the number of the holes being the same as the number of the lottery pockets. In this aspect, in case in which the mode selector has selected the first mode, the driver sets the position of the retention plate with respect to the roulette wheel so that the retaining members of the retention plate interposed between neighboring holes and the lottery pockets of the roulette wheel are superposed, whereby lottery balls that have entered the lottery pockets are retained by the retaining members below the lottery pockets without falling. In case in which the mode selector has selected the second mode, the driver sets the position of the retention plate with respect to the roulette wheel so that the holes and the lottery pockets of the roulette wheel are superposed, whereby lottery balls that have entered the lottery pockets fall through the holes below the lottery pockets.

In this aspect, since the balls are also retained at the roulette section in the first mode, players can easily confirm which pockets the balls have entered. After completion of the lottery, in order to retrieve the lottery balls, the driver sets the position of the retention plate so that the holes of the retention plate are positioned below the lottery pockets of the roulette wheel, whereby lottery balls that have entered the lottery pockets fall through holes below the lottery pockets. Therefore, all of the lottery balls having entered the lottery pockets fall down at the same time and are retrieved. In other words, with a simple structure, multiple lottery balls entering the lottery pockets can be retrieved at the same time.

In an aspect according to the present invention, the ball lottery apparatus may include a first retrieving section for retrieving lottery balls having fallen from the lottery pockets at a first area that is a half area of the roulette wheel; a second retrieving section for retrieving lottery balls having fallen from the lottery pockets at a second area that is another half area of the roulette wheel; a rotation controller adapted for controlling rotation of the roulette section; and a lottery controller adapted for deciding a lottery result depending on which lottery pockets the lottery balls have entered. In case in which the lottery controller executes a lottery, the mode selector may select the first mode, and the rotation controller may rotate the roulette section, and in which after the lottery controller decides the lottery result, the mode selector may select the second mode at a time point at which the difference between a total number of lottery balls entering the lottery pockets in the first area and a total number of lottery balls entering the lottery pockets in the second area is minimum. In addition, the rotation controller may stop the roulette section at the time point. Directly after the mode selector selects the second mode at the time point, the rotation controller may stop the roulette section. Alternatively, the rotation controller may stop the roulette section directly before the mode selector selects the second mode at the time point. In this aspect, when lottery balls are retrieved after a lottery is finished, the difference between the number of lottery balls retrieved by the first retrieving section and the number of lottery balls retrieved by the second retrieving section is minimized. "The difference between the number of lottery balls retrieved by the first retrieving section and the number of lottery balls retrieved by the second retrieving section is minimized" means that the difference is zero when the total number of lottery balls used in the lottery is an even number, and that the difference is one when the total number of lottery balls used in the lottery is an odd number.

The ball lottery apparatus of this aspect may further include: a confluence section where the lottery balls retrieved by the first retrieving section and the lottery balls retrieved by the second retrieving section meet; a ball input configured to input the lottery balls to the roulette section; and a carrier mechanism configured to carry the lottery balls forwarded from the confluence section to the ball input, in which the lottery balls retrieved by the first retrieving section may be forwarded to the confluence section through a first retrieving line that extends from the first retrieving section to an entrance of the confluence section, and in which the lottery balls retrieved by the second retrieving section may be forwarded to the confluence section through a second retrieving line that extends from the second retrieving section to the entrance of the confluence section.

When lottery balls are retrieved after a lottery is finished, if the number of lottery balls retrieved by the first retrieving section and the number of lottery balls 1*b* retrieved by the second retrieving section are unbalanced, obstruction of lottery balls may occur because many lottery balls are concentrated at the entrance of a retrieving line that is defined to have a width corresponding to the diameter of the lottery balls. However, in the aspect, when lottery balls are retrieved after a lottery is finished, the difference between the number of lottery balls retrieved by the first retrieving section and the number of lottery balls retrieved by the second retrieving section is minimized (balls are equally distributed). This results in limiting obstruction of lottery balls at the upstream position of the retrieving line.

In the first mode and the second mode, different types of lotteries may be offered. In the first mode, lottery balls cannot enter the lottery pockets where preceding lottery balls have already entered. Accordingly, the lottery is offered with the use of lottery balls of which the total number used in the single lottery is less than the total number of the lottery pockets. For example, it is preferable to apply the first mode to a bingo game or other games in which the numbers of the lottery pockets where lottery balls have entered are used with the use of lottery balls of which the total number is less than the total number of the lottery pockets. On the other hand, in the lottery offered in the second mode, multiple lottery balls can pass through a lottery pocket. Consequently, it is preferable to apply the lottery offered in the second mode into a game using a decision whether or not lottery balls have passed through all of the lottery pockets, with the use of lottery balls of which the total number is greater than the number of lottery pockets. In other words, the ball lottery apparatus according to the present invention may be applied in a game apparatus where the above-described games are provided. Such a game apparatus may include the ball lottery apparatus; and a game execution controller adapted to execute a first game in which a total number of the lottery balls used in a single lottery is less than a total number of the lottery pockets, and a lottery result obtained in case in which the mode selector has selected the first mode is utilized, and to execute a second game in which a total number of the lottery balls used in a single lottery is greater than a total number of the lottery pockets, and a lottery result obtained in case in which the mode selector selects the second mode is utilized.

BRIEF DESCRIPTION OF THE DRAWINGS

FIG. 10 is view for explaining an example of a scheme for stopping the roulette section at which the difference between the total number of lottery balls entering the lottery pockets in a first area of the roulette section and the total number of lottery balls entering the lottery pockets in a second area of the roulette section is minimum;

DESCRIPTION OF EMBODIMENTS

A. Embodiment

Figure 1:
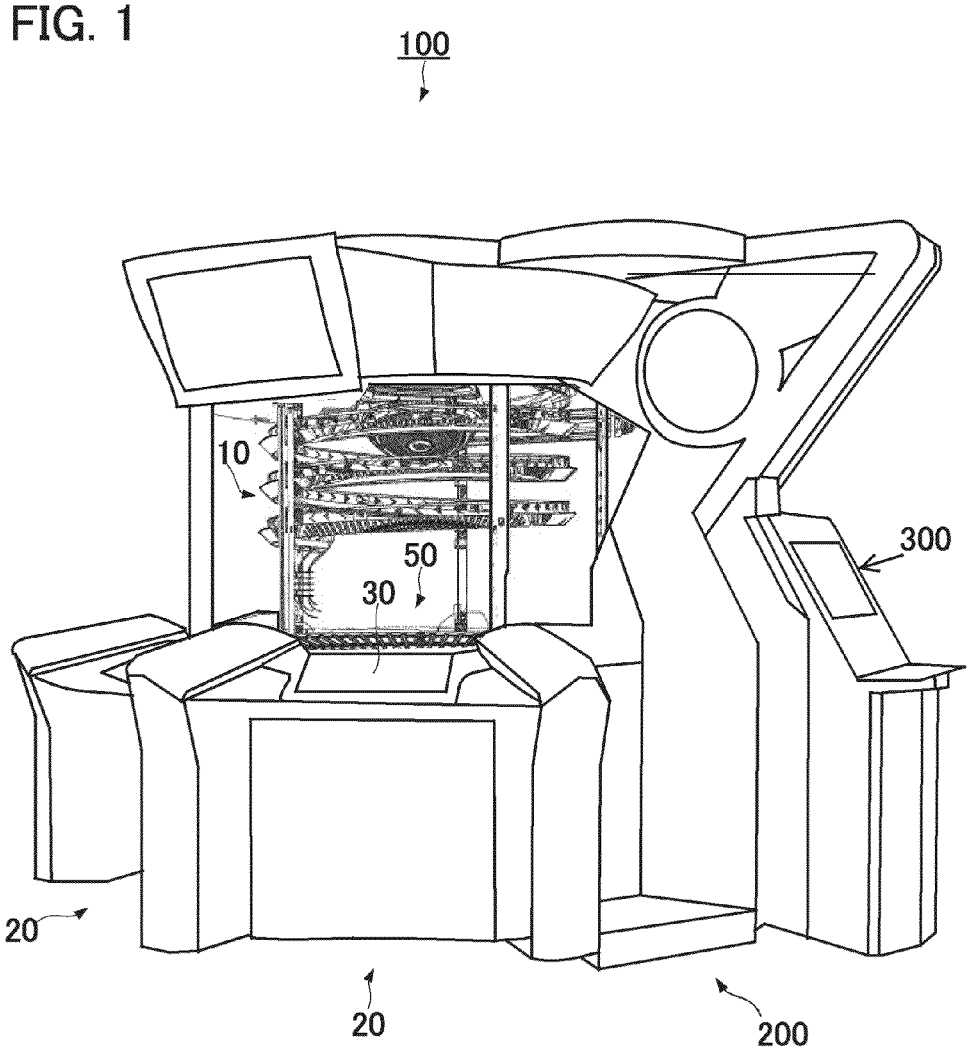
FIG. 1 is a view showing the appearance of a game apparatus according to an embodiment of the present invention.

FIG. 1 is a view showing the appearance of a game apparatus 100 according to an embodiment of the present invention. The game apparatus 100 offers a bingo game. As shown in FIG. 1, the game apparatus 100 includes a ball lottery apparatus 10 and multiple stations 20 arranged to surround the ball lottery apparatus 10. The game apparatus 100 includes a dealer station 200 where a game facility staff member may conduct various manipulations for intervening in the bingo game, and a credit deposit terminal 300 where players deposit credits, but these will not be explained in detail.

In each station 20, a single player plays the game. Each station 20 includes a coin slot (not shown) into which the player drops token coins (that may also be called "medals"), and a display unit 30 showing images corresponding to progress of the game. In this embodiment, the display unit 30 is formed of a liquid crystal touch panel, and it can serve as a manipulation section at which the player conducts manipulation with respect to the game. In this embodiment, a player plays the game at each single station, but the present invention is not limited to this embodiment, and multiple players may play the game in each single station 20. Furthermore, the number of the stations 20 may be freely selected.

Figure 2:
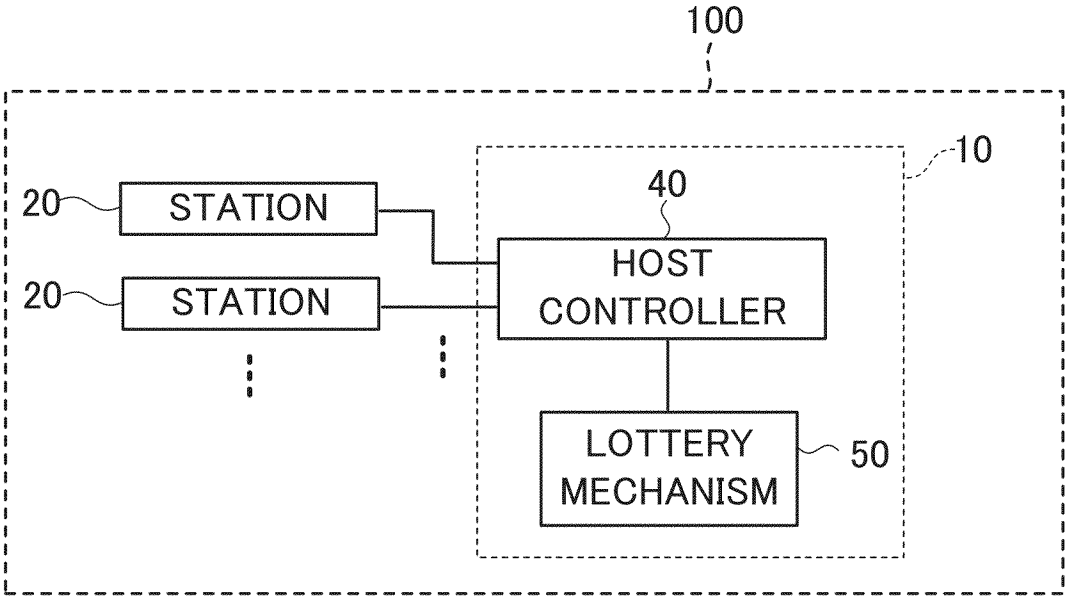
FIG. 2 is a block diagram showing the outline of a control system of the game apparatus.

FIG. 2 is a block diagram showing the outline of a control system of the game apparatus 100. The ball lottery apparatus 10 includes a host controller 40 and a lottery mechanism 50 that will be described later. The host controller 40 is a computer that controls the overall game apparatus 100 including the lottery mechanism 50 and the multiple stations 20.

Figure 3:
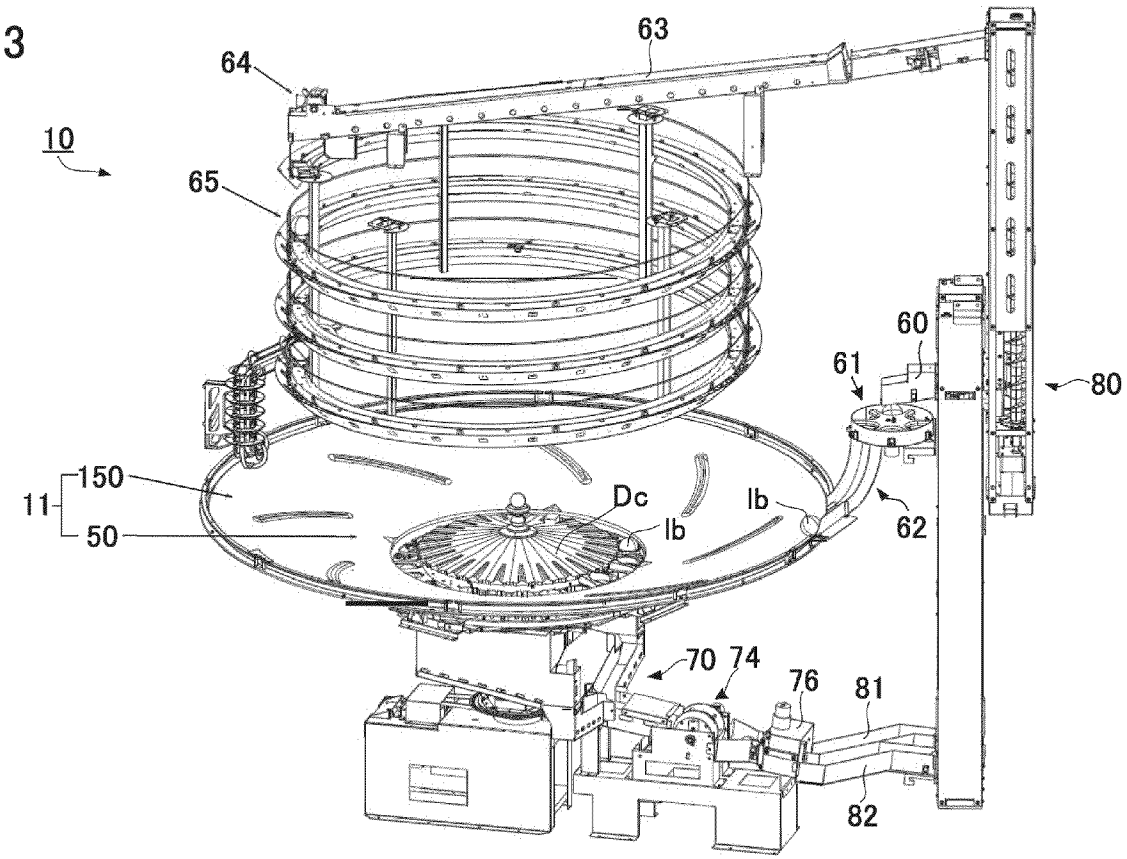
FIG. 3 is a perspective view showing a detailed structure of a ball lottery apparatus in the game apparatus.

FIG. 3 is a perspective view showing a detailed structure of a ball lottery apparatus 10. In FIG. 3, illustration of other elements in the game apparatus 100, e.g., the stations, is omitted. As shown in FIG. 3, the ball lottery apparatus 10 includes a field 150 on which multiple lottery balls 1*b* can roll, and a lottery mechanism 50 including a roulette section in which multiple lottery pockets are formed so that the lottery balls 1*b* may enter the lottery pockets. Furthermore, the ball lottery apparatus 10 includes a first reservoir 60 (ball input) capable of storing multiple lottery balls 1*b* used for the bingo game that will be described later, a first discharger 61 (ball input) capable of discharging the multiple lottery balls 1*b* stored in the first reservoir 60 individually (one by one) from the first reservoir 60, and a first rail 62 for guiding the lottery balls 1*b* discharged by the first discharger 61 into the field 150. Furthermore, the ball lottery apparatus 10 includes a second reservoir 63 (ball input) capable of storing multiple lottery balls 1*b* used for a special game that will be described later, a second discharger 64 (ball input) capable of discharging the multiple lottery balls 1*b* stored in the second reservoir 63 individually (one by one) from the second reservoir 63, and a second rail 65 of a spiral shape for guiding the lottery balls 1*b* discharged by the second discharger 64 onto the field 150. Furthermore, the ball lottery apparatus 10 includes a retrieval mechanism 70 for retrieving the lottery balls 1*b* that have entered the lottery pockets, a route switcher 76 for switching a route for carrying the lottery balls 1*b* out of the retrieval mechanism 70 to a first partition line 81 directed to the first reservoir 60 or to a second partition line 82 directed to the second reservoir 63, and a carrier mechanism 80 for carrying the lottery balls 1*b* that have been retrieved by the retrieval mechanism 70 to the first reservoir 60 or second reservoir 63.

Figure 4:
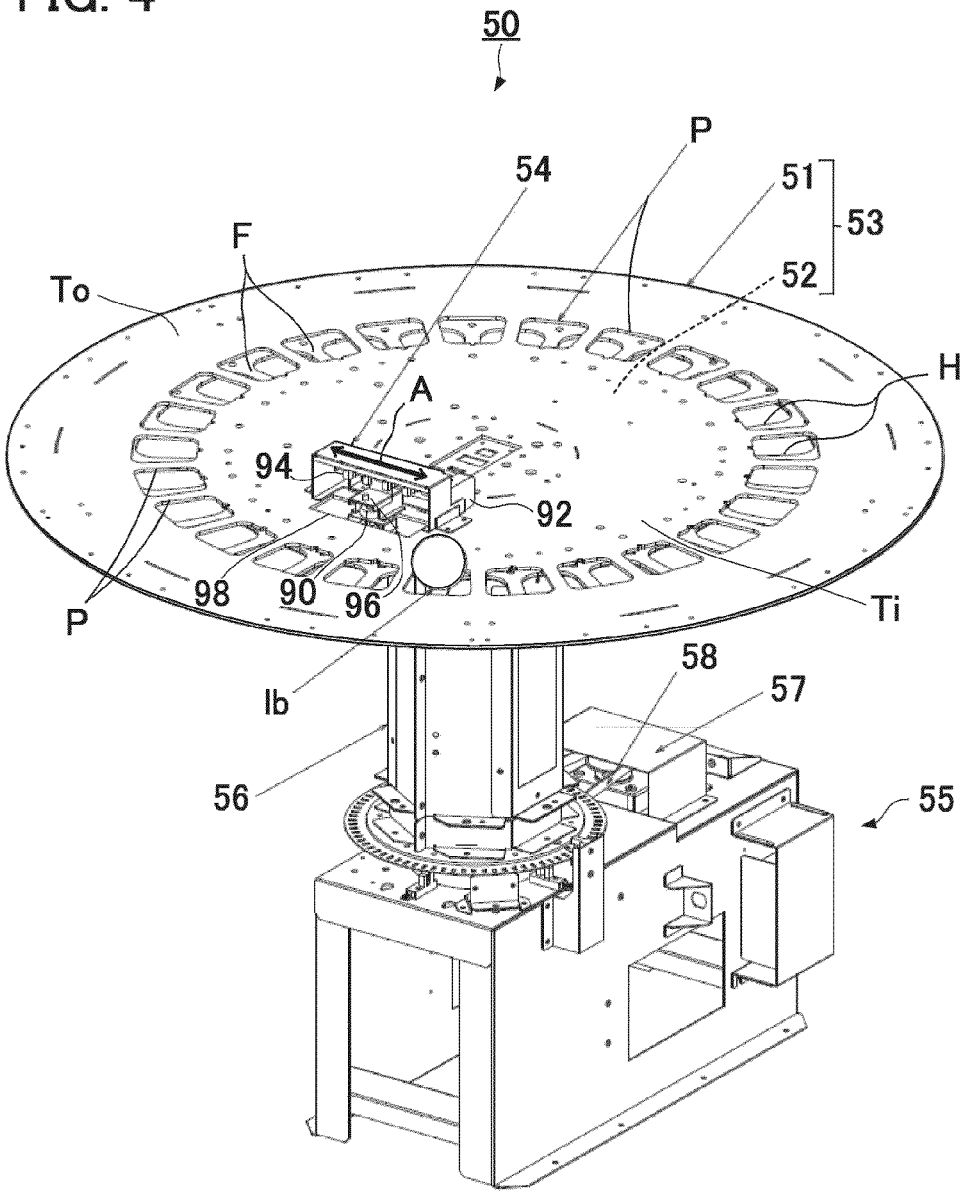
FIG. 4 is a perspective view showing a detailed structure of a lottery mechanism of the ball lottery apparatus when viewed from obliquely above.
Figure 5:
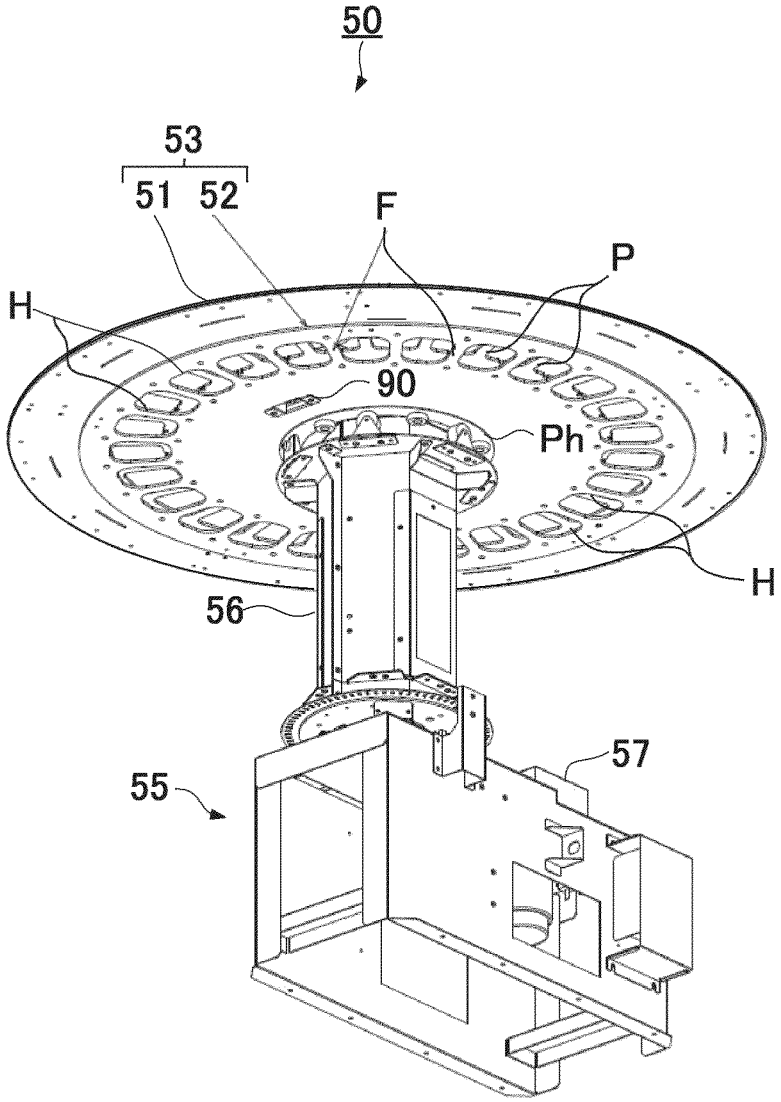
FIG. 5 is a perspective view showing a detailed structure of the lottery mechanism when viewed from obliquely below.

FIGS. 4 and 5 are perspective views showing the detailed structure of the lottery mechanism 50 in which a decorative member Dc shown in FIG. 3 is removed. As shown in FIGS. 4 and 5, the lottery mechanism 50 includes a roulette section 53 in which an upper disposed roulette wheel 51 and a lower disposed retention plate 52 are superposed and are rotatable as a unit, a slide motor unit 54 configured to alter the relative angular position of the retention plate 52 with respect to the roulette wheel 51, and a rotation mechanism 55 for rotating the roulette section 53.

The roulette wheel 51 is a generally circular plate in which multiple lottery pockets P through which the lottery balls 1*b* can pass are formed along a circumferential direction, and the plate is formed so that the more to the interior it is, the lower it is. There are 25 lottery pockets P in all, each of which corresponds to a number among numbers from 1 to 25, and the numbers are assigned to the lottery pockets P in such a manner that the number increases one by one in the clockwise direction. The slide motor unit 54 is mounted on a region Ti of the surface (upper surface) of the roulette wheel 51 surrounded by the multiple lottery pockets P, whereas a decorative member Dc shown in FIG. 3 is placed on the region Ti. Another region To of the surface of the roulette wheel 51 outside the multiple lottery pockets P is located beneath the field 150 and covered with the field 150. The distal end of a shaft 56 included in the rotation mechanism 55 is connected to the center of the reverse side (lower surface) of the roulette wheel 51. In this embodiment, the roulette wheel 51 is supported by the rotation mechanism 55.

The retention plate 52 is located below (at the side of the reverse surface of) the roulette wheel 51. As shown in FIGS. 4 and 5, the retention plate 52 is a generally circular plate in which multiple holes H through which the lottery balls 1*b* can pass are formed along a circumferential direction, the number of the holes H being the same as that of the lottery pockets P. At the center of the retention plate 52, a through-hole Ph is formed. As shown in FIG. 5, flat ribs F (retaining members) are interposed between neighboring holes H. A connection member 90 that protrudes upwardly from the retention plate 52 is provided on the retention plate 52. The retention plate 52 is supported by a support mechanism (not shown) that supports the retention plate 52, but does not support the roulette wheel 51.

As shown in FIG. 4, the above-mentioned slide motor unit 54 includes a slide motor 92, a screw shaft 94 that rotates driven by the slide motor 92, and a sliding member 96 attached to the screw shaft 94. When the slide motor 92 rotates, the screw shaft 94 rotates. By rotation of the screw shaft 94, the sliding member 96 attached to the screw shaft 94 is moved straight along the axial direction of the screw shaft 94. When the slide motor 92 is rotated, the sliding member 96 is moved in reverse. In FIG. 4, two-headed arrow A indicates the direction of the movement of the sliding member 96.

Furthermore, as shown in FIG. 4, an elongated hole 98 is formed at an area near the screw shaft 94 among the region Ti of the roulette wheel 51. The longitudinal direction of the elongated hole 98 is parallel to the axial direction of the screw shaft 94 (i.e., the movement direction of the sliding member). The above-mentioned connection member 90 affixed to the retention plate 52 penetrates through the elongated hole 98. In addition, the connection member 90 and the sliding member 96 are mutually connected to each other. With the connection member 90 and the sliding member 96 being connected, when the sliding member 96 moves along the longitudinal direction of the elongated hole 98, the retention plate 52 rotates with respect to the roulette wheel 51 by an angle corresponding to the distance of movement of the sliding member 96. That is to say, movement of the sliding member 96 connected to the connection member 90 along the longitudinal direction of the elongated hole 98 causes change in the angular position of the retention plate 52 with respect to the roulette wheel 51.

Figure 6:
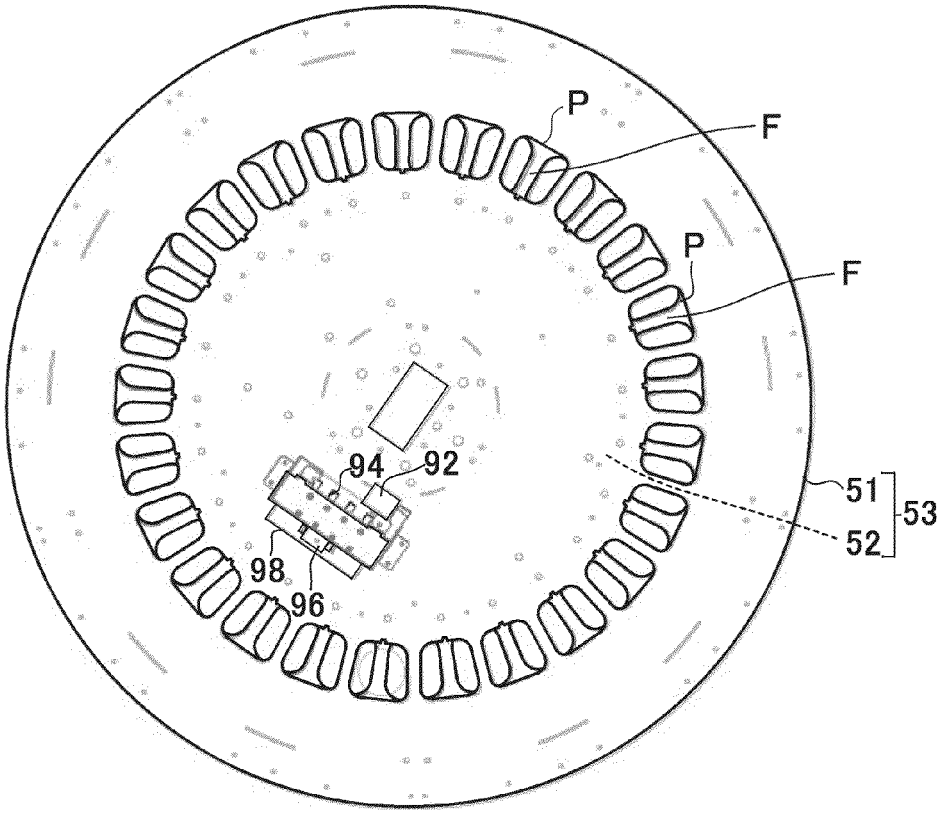
FIG. 6 is a plan view of a roulette section of the ball lottery apparatus in a ball-hold status.

In this embodiment, when the bingo game is played, the host controller 40 (driver) controls the slide motor unit 54 (driver) to adjust the angle of the retention plate 52 so that the ribs F interposed between neighboring holes H of the retention plate 52 and the lottery pockets P of the roulette wheel 51 are superposed in order that lottery balls 1*b* entering the lottery pockets P be retained by the ribs F under the lottery pockets P without falling. FIG. 6 is a plan view of the roulette section 53 in this status. As will be understood from FIG. 6, the angular position of the retention plate 52 is set so that the ribs F interposed between neighboring holes H of the retention plate 52 are located under the lottery pockets P of the roulette wheel 51. Therefore, lottery balls 1*b* entering the lottery pockets P are retained by the ribs F under the lottery pockets P without falling. In this embodiment, the position of the sliding member 96 at this stage is near the center of the elongated hole 98 in its longitudinal direction. The position of the sliding member 96 at this time is referred to as a "first position", and the status of the roulette section 53 at this time is referred to as a "ball-hold status".

Figure 7:
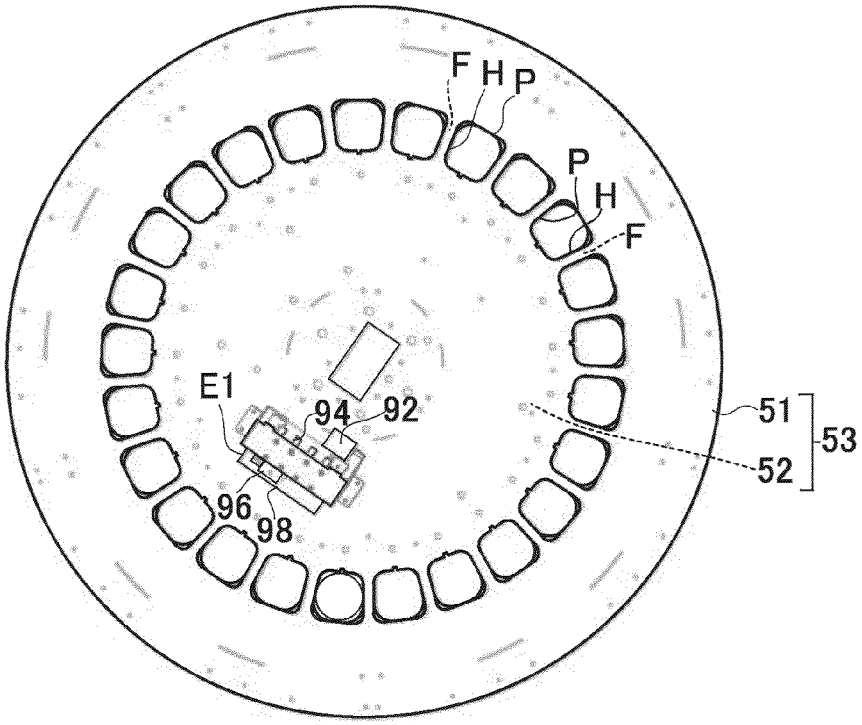
FIG. 7 is a plan view of the roulette section of the ball lottery apparatus in a ball-through status.

In this embodiment, when the lottery balls 1*b* having entered the lottery pockets P are retrieved after each bingo game is finished, or when the special game that will be described later is played, the host controller 40 (driver) controls the slide motor unit 54 (driver) to adjust the angle of the retention plate 52 so that the holes H of the retention plate 52 and the lottery pockets P of the roulette wheel 51 are superposed in order that lottery balls 1*b* having entered the lottery pockets P fall from the lottery pockets through the holes H. FIG. 7 is a plan view of the roulette section 53 in this status. As will be understood from FIG. 7, the angular position of the retention plate 52 is set so that the holes H are located under the lottery pockets P. Therefore, lottery balls 1*b* entering the lottery pockets P fall through the holes H under the lottery pockets P. In this embodiment, the position of the sliding member 96 at this stage is near an end E1 of the elongated hole 98 in its longitudinal direction. The position of the sliding member 96 at this time is referred to as a "second position", and the status of the roulette section 53 at this time is referred to as a "ball-through status".

In order to switch the roulette section 53 from the ball-through status to the ball-hold status, the host controller 40 controls the slide motor unit 54 to move the sliding member 96 from the second position to the first position, whereby the retention plate 52 is revolved counterclockwise with respect to the roulette wheel 51. Once the ribs F interposed between neighboring holes H of the retention plate 52 are positioned under the lottery pockets P of the roulette wheel 51, the host controller 40 stops the rotation of the slide motor unit 54 to stop the revolution of the retention plate 52. On the other hand, in order to switch the roulette section 53 from ball-hold status to the ball-through status, the host controller 40 controls the slide motor unit 54 to move the sliding member 96 from the first position to the second position, whereby the retention plate 52 is revolved clockwise with respect to the roulette wheel 51. Once the holes H of the retention plate 52 are located under the lottery pockets P of the roulette wheel 51, the host controller 40 stops the rotation of the slide motor unit 54 to stop the revolution of the retention plate 52.

When the slide motor unit 54 is not driven, the retention plate 52 is not able to move with respect to the roulette wheel 51 since the sliding member 96 and the connection member 90 are securely connected to the screw shaft 94. In this status, when the shaft 56 fixed to the roulette wheel 51 is rotated, the retention plate 52 is rotated together with the roulette wheel 51.

As shown in FIGS. 4 and 5, the above-mentioned rotation mechanism 55 includes a shaft 56, a motor unit 57, and a timing belt 58. The motor unit 57 contains a driving motor (not shown). The rotation of the driving motor is transmitted via the timing belt 58 to the shaft 56, so that the shaft 56 is rotated. The rotation of the shaft 56 causes rotation of the roulette section 53. More specifically, when the shaft 56 is rotated, the roulette wheel 51, the retention plate 52, and the slide motor unit 54 are rotated jointly. In other words, in either of the ball-hold status or the ball-through status, it is possible to rotate the roulette section 53. In addition, during rotation of the roulette section 53, it is possible to switch from the ball-hold status to the ball-through status, and to switch from the ball-through status to the ball-hold status.

Figure 8:
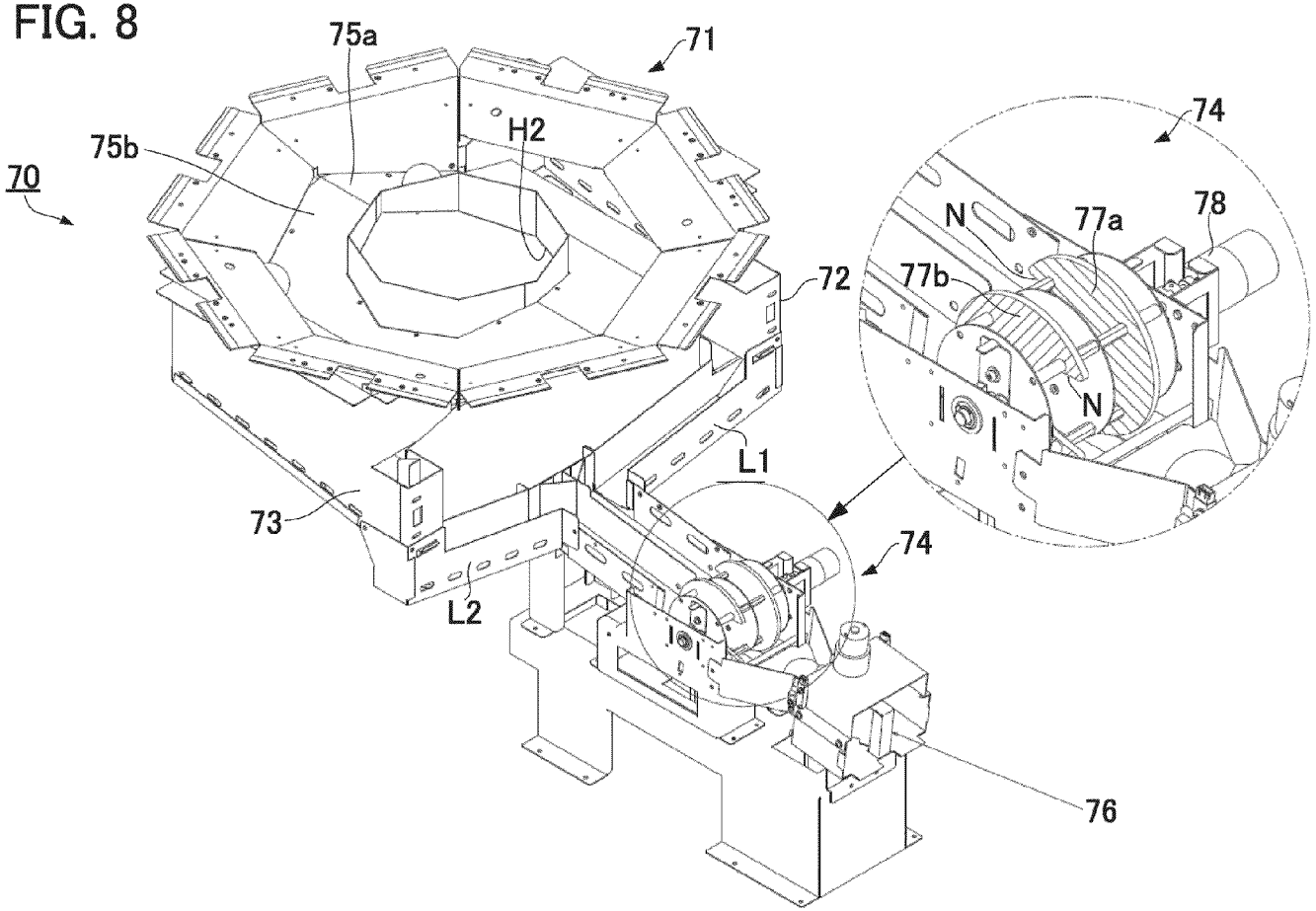
FIG. 8 is a perspective view showing a detailed structure of a retrieval mechanism of the ball lottery apparatus.

FIG. 8 is a perspective view showing a detailed structure of the retrieval mechanism 70. The retrieval mechanism 70 is located below the roulette section 53. As shown in FIG. 8, the retrieval mechanism 70 includes a main body 71 having a center area in which a hole H2 through which the shaft 56 penetrates is formed; a first retrieving duct 72 formed at the right lower side of the main body 71 viewed from above; a second retrieving duct 73 formed at the left lower side of the main body 71 viewed from above, a confluence section 74, a first retrieving line L1 extending from the first retrieving duct 72 to the entrance of the confluence section 74, and a second retrieving line L2 extending from the second retrieving duct 73 to the entrance of the confluence section 74.

As shown in FIG. 8, the main body 71 includes a first sloping surface 75*a* (first retrieving section) communicated with the first retrieving duct 72 (first retrieving section), and a second sloping surface 75*b* (second retrieving section) communicated with the second retrieving duct 73 (second retrieving section). All multiple lottery pockets P of the roulette wheel 51 are located above the area formed by the first sloping surface 75*a* and the second sloping surface 75*b*. Whereas a half of the lottery pockets P laps over the first sloping surface 75*a*, the other half of the lottery pockets P laps over second sloping surface 75*b*. Lottery balls 1*b* having fallen from the lottery pockets P in a first area of the roulette wheel 51 that is an area lapping over the first sloping surface 75*a* roll on the first sloping surface 75*a* and are directed to (retrieved by) the first retrieving duct 72. Lottery balls 1*b* having been retrieved by the first retrieving duct 72 are forwarded through the first retrieving line L1 to the confluence section 74. Lottery balls 1*b* having fallen from the lottery pockets P in a second area of the roulette wheel 51 that is an area lapping over the second sloping surface 75*b* roll on the second sloping surface 75*b* and are directed to (retrieved by) the second retrieving duct 73. Lottery balls 1*b* having been retrieved by the second retrieving duct 73 are forwarded through the second retrieving line L2 to the confluence section 74. Since the roulette section 53 rotates, the first area and the second area are variable. If the total number of the lottery pockets P is an odd number, a lottery pocket P may be located on the boundary between the first area and the second area. A lottery ball 1*b* having fallen from such a lottery pocket positioned on the boundary is directed to either of the first retrieving duct 72 and the second retrieving duct 73, the destination depending on whether the landing position of the ball is the first sloping surface 75*a* or the second sloping surface 75*b*. More specifically, if the lottery ball 1*b* having fallen from the lottery pocket on the boundary lands on the first sloping surface 75*a*, it is guided to the first retrieving duct 72. If it lands on the second sloping surface 75*b*, it is guided to the second retrieving duct 73. If the total number of lottery balls 1*b* used in a lottery is an even number, it is preferable to avoid any lottery pocket P where a lottery ball 1*b* has entered from being located on the boundary when stopping the roulette section 53. However, if the total number of lottery balls 1*b* used in a lottery is an odd number, a lottery pocket P where a lottery ball 1*b* has entered may be located on the boundary when stopping the roulette section 53.

As shown in the enlarged view in FIG. 8, the confluence section 74 includes a first conveyor 77*a* for conveying the lottery balls 1*b* forwarded from the first retrieving line L1 to the route switcher 76, a second conveyor 77*b* for conveying the lottery balls 1*b* forwarded from the second retrieving line L2 to the route switcher 76, and a driving motor 78. Each of the first conveyor 77*a* and the second conveyor 77*b* is a circular plate in which a cutout N is formed into which each of lottery balls 1*b* can enter. Whereas the first conveyor 77*a* is located at the exit of the first retrieving line L1, the second conveyor 77*b* is located at the exit of the second retrieving line L2.

The first conveyor 77*a* and the second conveyor 77*b* are rotatable about a common axis (not shown) driven by the driving motor 78. By rotation of the first conveyor 77*a* and the second conveyor 77*b*, lottery balls 1*b* arranged in two rows at the exits of the first retrieving line L1 and the second retrieving line L2 (at the entrance of the confluence section 74) enter the cutouts N of the first conveyor 77*a* and the second conveyor 77*b*, and are conveyed to the route switcher 76. In this embodiment, the angular positions and the shapes of the cutouts N of the first conveyor 77*a* and the second conveyor 77*b* are decided in order that lottery balls 1*b* in the first retrieving line L1 and lottery balls 1*b* in the second retrieving line L2 are conveyed alternately to the route switcher 76.

The route switcher 76 is a means for switching the route for conveying lottery balls forwarded from the confluence section 74. As shown in FIG. 3, the exit side of the route switcher 76 is bifurcated into the first partition line 81 and the second partition line 82. Under control of the host controller 40, the route switcher 76 switches the route for conveying lottery balls 1*b* to the first partition line 81 or the second partition line 82. The carrier mechanism 80 includes a first carrying line for carrying the lottery balls 1*b* to the first reservoir, and a second carrying line for carrying the lottery balls 1*b* to the second reservoir 63. The first partition line 81 is communicated with the first carrying line, whereas the second partition line 82 is communicated with the second carrying line.

When the route for carrying the lottery balls 1*b* is switched to the first partition line 81 by the route switcher 76, lottery balls 1*b* are carried to the first partition line 81 and are sent to the first reservoir 60 through the first carrying line of the carrier mechanism 80. When the route for carrying the lottery balls 1*b* is switched to the second partition line 82 by the route switcher 76, lottery balls 1*b* are carried to the second partition line 82 and are sent to the second reservoir 63 through the second carrying line of the carrier mechanism.

Next, the flow of games performed in the game apparatus 100 will be described in more detail. In this embodiment, two sorts of games including the bingo game (first game) and the special game (second game) can be performed in the game apparatus 100. The special game is a game started if a predetermined requirement is satisfied and is different from the bingo game.

Figure 9:
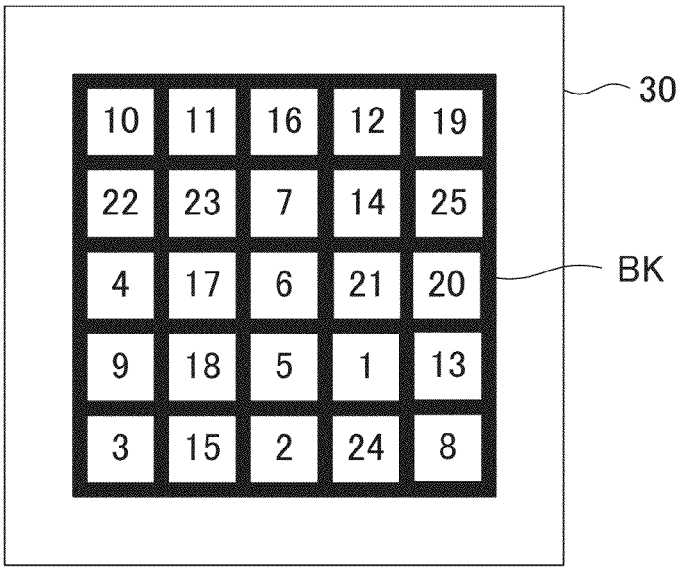
FIG. 9 is a view showing an image of a bingo card displayed on a display unit of the game apparatus.

Aspects of the bingo game will be described. At the initial status at which players start games, the host controller 40 controls the game apparatus 100 to execute the bingo game. In this embodiment, there are provided a "ball-hold mode" (first mode) and a "ball-through mode" (second mode) for the roulette section 53. For executing the bingo game, the host controller 40 (mode selector) selects the ball-hold mode and controls the game apparatus 100 according to the ball-hold mode. In the ball-hold mode, the host controller 40 controls the slide motor unit 54 so that the roulette section 53 is in the ball-hold status. Accordingly, when the lottery balls 1*b* enter the lottery pockets P, the lottery balls 1*b* are retained by the roulette section 53 without falling. In addition, the host controller 40 controls the display unit 30 of each station 20 for causing the display unit 30 to show an image of a bingo card BK, an example of which is shown in FIG. 9. The bingo card BK is a card in which numbers from one to 25 are randomly arranged in a matrix of five rows and five columns, and actually it is presented to the players as only an image on the display units 30. The arrangement of the numbers on the bingo card BK is set to vary depending on the station 20 (i.e., the player).

In the ball-hold mode, the host controller 40 (game execution controller, rotation controller) controls the rotation mechanism 55 to rotate the roulette section 53, and controls the first discharger 61 for causing the first discharger 61 to discharge lottery balls 1*b* individually in compliance with a predetermined rule. In this embodiment, for performing each bingo game, six lottery balls 1*b* are sequentially discharged from the first discharger 61 and guided to the field 150. Then, each lottery ball 1*b* rolling on the field 150 enters any of the lottery pockets P of the rotating roulette section 53. In the ball-hold mode, the balls 1*b* are retained by the roulette section 53, so that players can easily confirm which pockets P the balls 1*b* have entered.

The host controller 40 (lottery controller) decides the lottery result depending on which lottery pockets P where six lottery balls 1*b* used in each single bingo game have entered. Details are as follows. As described above, the lottery pockets P correspond to numbers one to 25, respectively. When a lottery ball 1*b* enters any of the multiple lottery pockets P, the number on the bingo card BK of each player corresponding to the lottery pocket P that have accepted the ball becomes effective, i.e., filled. The host controller 40 determines that the "bingo" has been realized if five effective (filled) numbers are aligned straight in a vertical, horizontal, or diagonal direction on the bingo card BK.

Once a single bingo game is finished (once the decision of the lottery result is finished), while maintaining the lottery balls 1*b* retained in the lottery pockets P, the host controller 40 (mode selector) controls the rotation mechanism 55 to stop the roulette section 53 at a time point at which the difference between the total number of lottery balls 1*b* entering the lottery pockets P in the first area of the roulette wheel 51 that is an area lapping over the first sloping surface 75*a* and the total number of lottery balls 1*b* entering the lottery pockets P in the second area of the roulette wheel 51 that is an area lapping over the second sloping surface 75*b* is minimum. In addition, the host controller 40 (mode selector) selects the ball-through mode. In this embodiment, the host controller 40 (mode selector, rotation controller) controls the rotation mechanism 55 to stop the roulette section 53 at a time point at which the total number of lottery balls 1*b* entering the lottery pockets P in the first area is three and the total number of lottery balls 1*b* entering the lottery pockets P in the second area is also three, and selects the ball-through mode. The order of stopping the roulette section 53 and selecting the ball-through mode is not limited, and they may be executed simultaneously.

Next, an example of a scheme for stopping the roulette section 53 at which the difference between the total number of lottery balls 1*b* entering the lottery pockets P in the first area and the total number of lottery balls 1*b* entering the lottery pockets P in the second area is minimum will be described. In this embodiment, the total number of lottery pockets P is 25, so that the number of lottery pockets P in the first area is 12 and that in the second area is 12. A single lottery pocket P is located on the boundary between the first area and the second area. The total number of lottery balls 1*b* used in a single lottery is six, so that it is necessary to distribute three lottery balls in each of the first area and the second area. In this case, the difference between the total number of the lottery balls 1*b* entering the lottery pockets P in the first area and that in the second area is zero.

With reference to FIG. 10, a specific example will be described. Let us assume that a first lottery ball ((1) in FIG. 10) has entered a third lottery pocket P3, a second lottery ball ((2) in FIG. 10) has entered a fifth lottery pocket P5, a third lottery ball ((3) in FIG. 10) has entered a ninth lottery pocket P9, a fourth lottery ball ((4) in FIG. 10) has entered a fourteenth lottery pocket P14, a fifth lottery ball ((5) in FIG. 10) has entered a twentieth lottery pocket P20, and a sixth lottery ball ((6) in FIG. 10) has entered a twenty-third lottery pocket P23. The number of each lottery ball is attached to the ball for the sake of convenience.

First, for each lottery ball, the number of pockets from the pocket accepting the present lottery ball to the pocket accepting another lottery ball that is three balls ahead of the present lottery ball in the clockwise direction (another lottery ball having a ball number that is three greater than that of the present lottery ball) is calculated. For example, for the first lottery ball (1), another lottery ball that is three balls ahead of the present lottery ball (first lottery ball (1)) in the clockwise direction is the fourth lottery ball (4). The number of pockets from the pocket (third lottery pockets P3) accepting the first lottery ball (1) to the pocket (fourteenth lottery pockets P14) accepting the fourth lottery ball (4) that is three balls ahead of the present lottery ball in the clockwise direction is 12, which corresponds to the difference between the pockets number P3 and P14. Similarly, for the second lottery ball (2), the number of pocket 16 is obtained, whereas for the third lottery ball (3), the number of pocket 15 is obtained. For the fourth lottery ball (4), the number of pocket 15 is obtained, whereas for the fifth lottery ball (5), the number of pocket 11 is obtained, and for the sixth lottery ball (6), the number of pocket 12 is obtained. Another lottery ball that is two balls ahead of the present lottery ball should be located in the area where the present lottery ball is located, whereas another lottery ball that is three or more balls ahead of the present lottery ball should be located in the area other than the area where the present lottery ball is located. In the example shown in FIG. 10, the lottery balls of which the number of pockets to another lottery ball that is three balls ahead is equal to or greater than 13 are the second lottery ball (2) (the number of pockets is 16), the third lottery ball (3) (the number of pockets is 15), and the fourth lottery ball (4) (the number of pockets is 15).

If the roulette section 53 is stopped when lottery pocket P5 accepting the second lottery ball (2) is located at the top of the first area (corresponding to the second status in FIG. 10), lottery pocket P5 accepting the second lottery ball (2), lottery pocket P9 accepting the third lottery ball (3), and lottery pocket P14 accepting the fourth lottery ball (4) are located in the first area, whereas lottery pocket P20 accepting the fifth lottery ball (5), lottery pocket P23 accepting the sixth lottery ball (6), and lottery pocket P3 accepting the first lottery ball (1) are located in the second area. In other words, three lottery balls are located in each of the first area and the second area.

If the roulette section 53 is stopped when lottery pocket P9 accepting the third lottery ball (3) is located at the top of the first area (corresponding to the third status in FIG. 10), lottery pocket P9 accepting the third lottery ball (3), lottery pocket P14 accepting the fourth lottery ball (4), and lottery pocket P20 accepting the fifth lottery ball (5) are located in the first area, whereas lottery pocket P23 accepting the sixth lottery ball (6), lottery pocket P3 accepting the first lottery ball (1), and lottery pocket P5 accepting the second lottery ball (2) are located in the second area. Accordingly, three lottery balls are located in each of the first area and the second area.

If the roulette section 53 is stopped when lottery pocket P14 accepting the fourth lottery ball (4) is located at the top of the first area (corresponding to the fourth status in FIG. 10), lottery pocket P14 accepting the fourth lottery ball (4), lottery pocket P20 accepting the fifth lottery ball (5), and lottery pocket P23 accepting the sixth lottery ball (6) are located in the first area, whereas lottery pocket P3 accepting the first lottery ball (1), lottery pocket P5 accepting the second lottery ball (2), and lottery pocket P9 accepting the third lottery ball (3) are located in the second area. Accordingly, three lottery balls are located in each of the first area and the second area. Therefore, the roulette section 53 should be stopped so that lottery pocket P5 accepting the second lottery ball (2), lottery pocket P9 accepting the third lottery ball (3), or lottery pocket P14 accepting the fourth lottery ball (4) are located at the top of the first area.

On the other hand, for the first lottery ball (1), the number of pockets to another lottery ball that is three balls ahead is 12, which is less than 13. If the roulette section 53 is stopped when lottery pocket P5 accepting the second lottery ball (2) is located at the top of the first area (corresponding to the first status in FIG. 10), lottery pocket P9 accepting the third lottery ball (3), lottery pocket P5 accepting the second lottery ball (2), lottery pocket P9 accepting the third lottery ball (3), and lottery pocket P14 accepting the fourth lottery ball (4) are located in the first area, whereas lottery pocket P20 accepting the fifth lottery ball (5) and lottery pocket P23 accepting the sixth lottery ball (6) are located in the second area. In the first status, four lottery balls are located whereas two lottery balls are located in the second area, and lottery balls are not equally distributed to the first area and the second area. If the roulette section 53 is stopped when lottery pocket P20 accepting the fifth lottery ball (5) is located at the top of the first area (corresponding to the fifth status in FIG. 10), the same is true. Also, if the roulette section 53 is stopped when lottery pocket P23 accepting the sixth lottery ball (6) is located at the top of the first area (corresponding to the sixth status in FIG. 10), the same is true.

In the ball-through mode, the host controller 40 controls the slide motor unit 54 so that the roulette section 53 is in the ball-through status. Accordingly, the six lottery balls 1*b* having entered the lottery pockets P fall at the same time from the lottery pockets P, and are retrieved by the retrieval mechanism 70. More specifically, three lottery balls 1*b* having entered lottery pockets P in the first area are retrieved by the first retrieving duct 72, and are forwarded via the first retrieving line L1 to the confluence section 74, whereas three lottery balls 1*b* having entered lottery pockets P in the second area are retrieved by the second retrieving duct 73, and are forwarded via the second retrieving line L2 to the confluence section 74.

At this stage, the host controller 40 controls the route switcher 76 so that the route for transferring the lottery balls 1*b* sent from the confluence section 74 is the first partition line 81. The lottery balls 1*b* conveyed into the first partition line 81 are sent through the first carrying line in the carrier mechanism 80 to the first reservoir 60. Consequently, the retrieved six lottery balls 1*b* are transferred to the first reservoir 60 again and are used for the next bingo game.

As described above, after each bingo game is finished, for retrieving lottery balls 1*b*, the host controller 40 controls the angular position of the retention plate 52 so that the holes H of the retention plate 52 and the lottery pockets P of the roulette wheel 51 are superposed, whereby all lottery balls having entered lottery pockets P fall at the same time through the holes H below the lottery pockets P. In other words, the embodiment with a simple structure using the slide motor unit 54 as a sole driver has an advantage in that multiple lottery balls 1*b* entering the lottery pockets P can be retrieved at the same time.

As described above, when a lottery is offered in the ball-hold mode, lottery balls 1*b* cannot enter the lottery pockets P where preceding lottery balls 1*b* have already entered. Accordingly, the lottery is offered using the numbers of the lottery pockets P where lottery balls 1*b* have entered with the use of lottery balls 1*b* of which the total number (six) is less than the total number (25) of the lottery pockets P.

Once a single bingo game is finished, the host controller 40 controls the rotation mechanism 55 to stop the roulette section 53 at a time point at which the difference between the total number of lottery balls entering the lottery pockets in the first area of the roulette section and the total number of lottery balls entering the lottery pockets in the second area of the roulette section is minimum. Accordingly, the number of lottery balls 1*b* retrieved by the first retrieving duct 72 can be the same as the number of lottery balls 1*b* retrieved by the second retrieving duct 73. This results in restricting obstruction of lottery balls 1*b* at the connections between the respective retrieving ducts 72 and 73 and the retrieving lines L1 and L2 (entrances of the retrieving lines).

When lottery balls 1*b* are retrieved after a bingo game is finished, if the difference between the number of lottery balls 1*b* retrieved by the first retrieving duct 72 and the number of lottery balls 1*b* retrieved by the second retrieving duct 73 is large, obstruction of lottery balls 1*b* may occur at either of connections between the respective retrieving ducts 72 and 73 and the retrieving lines L1 and L2 (entrances of the retrieving lines) where many more lottery balls are directed. However, in the embodiment, when lottery balls 1*b* are retrieved after a bingo game is finished, the difference between the number of lottery balls 1*b* retrieved by the first retrieving duct 72 and the number of lottery balls 1*b* retrieved by the second retrieving duct 73 is minimized. This results in restricting obstruction of lottery balls 1*b* at the upstream position of the retrieving line L1 or L2. "The difference between the number of lottery balls 1*b* retrieved by the first retrieving duct 72 and the number of lottery balls 1*b* retrieved by the second retrieving duct 73 is minimized" means that the difference is zero when the total number of lottery balls 1*b* used in the lottery is an even number, and that the difference is one when the total number of lottery balls 1*b* used in the lottery is an odd number.

Aspects of the special game will be described. If a predetermined requirement is satisfied in a bingo game, the host controller 40 starts executing the special game directly after finishing the bingo game having been performed. The predetermined requirement is optional. For example, if the number of realization of bingo for a player becomes in excess of a predetermined number, the special game may be started.

When performing the special game (second game), the host controller 40 (mode selector) selects the ball-through mode, and controls the retention plate 52 so that the roulette section 53 is in the ball-through status. In this status, the host controller 40 (game execution controller) controls the rotation mechanism 55 to rotate the roulette section 53, and controls the second discharger 64 to discharge sequentially a plurality of (for example, 70) lottery balls 1*b* reserved in the second reservoir 63. The lottery balls 1*b* discharged from the second discharger 64 are directed to the field 150 at predetermined time intervals through the spiral second rail 65. Then, the lottery balls 1*b* rolling on the field 150 enter any of the lottery pockets P in the rotating roulette section 53.

In the special game, when a lottery ball 1*b* enters one of the multiple lottery pockets P, token coins of which the number is the same as the number corresponding to the lottery pocket P where the lottery ball 1*b* entered are paid out to the player. In this embodiment, when lottery balls 1*b* enter all of the lottery pockets P, the host controller 40 decides that the requirement for a "special prize" is satisfied and pays out a large number of token coins (for example, 1,000 token coins) to the player. Instead of token coins, coupons or vouchers may be paid out.

When the special game is performed, the roulette section 53 is set to the ball-through status, so that lottery balls 1*b* having entered the lottery pockets P fall through holes H positioned under the lottery pockets P and are retrieved by the retrieval mechanism 70. In this stage, the host controller 40 controls the route switcher 76 so that the route for transferring the lottery balls 1*b* sent from the confluence section 74 is the second partition line 82. The lottery balls 1*b* conveyed into the second partition line 82 are directed through the second carrying line in the carrier mechanism 80 to the second reservoir 63. Consequently, the retrieved lottery balls 1*b* are transferred to the second reservoir 63, and are discharged sequentially from the second discharger 64 again. In this embodiment, the host controller 40 finishes the special game once the second discharger 64 completes discharging 70 lottery balls 1*b*.

As described above, when a lottery is offered in the ball-through mode, multiple lottery balls 1*b* can pass through a lottery pocket P. Consequently, using lottery balls 1*b* of which the total number (70) is much greater than the number (25) of lottery pockets P, the lottery is made with the use of the decision whether or not lottery balls 1*b* have passed through all of the lottery pockets P.

B. Variations

The above-described embodiments may be modified in various different ways. Examples of specific variations are described below. Two or more variations freely selected from the below variations may be combined.

1) Variation 1

Figure 11:
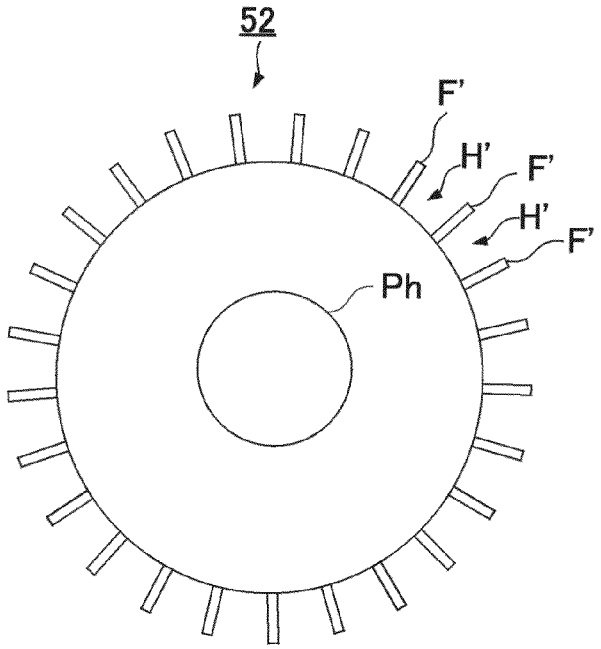
FIG. 11 is a plan view of a retention plate in the roulette section of the ball lottery apparatus according to a variation of the present invention.

In the above-described embodiment, the retention plate 52 is a generally circular plate in which multiple holes H are formed along the circumferential direction, in which the number of the holes H is the same as that of the lottery pockets P of the roulette wheel 51, and in which a through-hole Ph is formed at the center of the retention plate 52. However, the retention plate 52 is not limited to the embodiment. Since the retention plate 52 is arranged below (at the side of the reverse surface of) the roulette wheel 51, the contour of the retention plate 52 may be freely selected, and for example, it may be a polygonal plate. Alternatively, as shown in FIG. 11, the retention plate 52 may be a generally circular plate having multiple (i.e., 25) ribs F' (retaining members) formed along the circumferential direction and radially extending outward for retaining the lottery balls 1*b* without falling, in which a through-hole Ph is formed at the center of the retention plate 52. In the variation of FIG. 11, multiple spaces H' are interposed between neighboring ribs F', so that lottery balls 1*b* can pass through the spaces H'.

In the variation of FIG. 11, when the roulette section 53 is in the ball-hold status, the angular position of the retention plate 52 is controlled so that the ribs F' of the retention plate 52 and the lottery pockets P of the roulette wheel 51 are superposed, whereby lottery balls 1*b* entering the lottery pockets P are retained by the ribs F' under the lottery pockets P. When the roulette section 53 is in the ball-through status, the angular position of the retention plate 52 is controlled so that the spaces H' between the ribs F' of the retention plate 52 and the lottery pockets P of the roulette wheel 51 are superposed, whereby lottery balls 1*b* entering the lottery pockets P fall through the spaces H' under the lottery pockets P.

In summary, the shape of the retention plate 52 may be selected, such that it includes retaining members corresponding to lottery pockets P, respectively, for retaining lottery balls 1*b* entering the lottery pockets P without falling, and spaces interposed between neighboring retaining members for permitting passage of the lottery balls 1*b*. In the above-described embodiment of the retention plate 52, the flat ribs F are the "retaining members", and the holes H are the "spaces".

2) Variation 2

Figure 12:
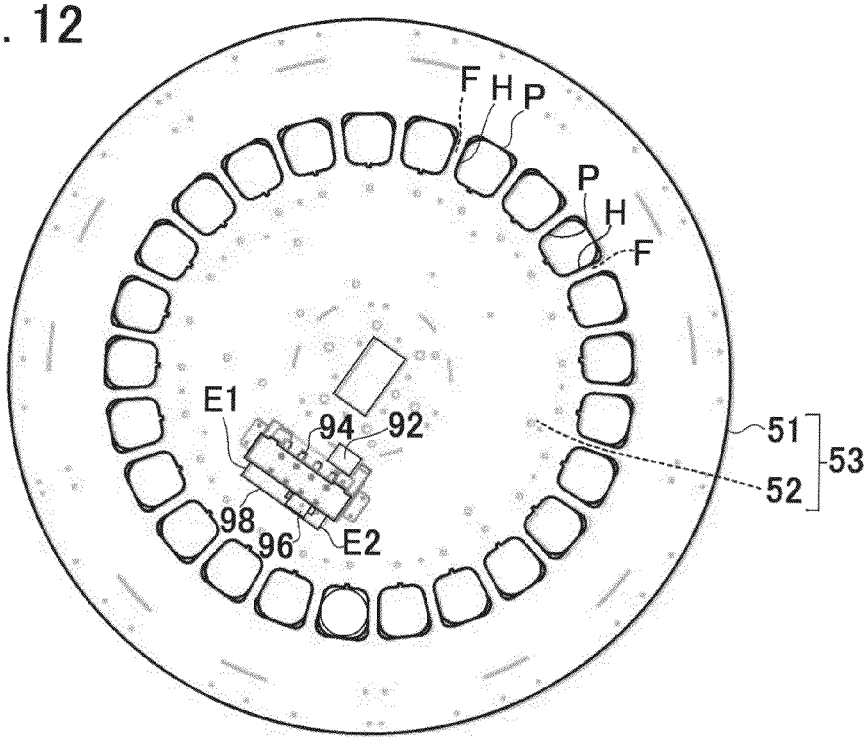
FIG. 12 is a view for explaining a variation of a method for switching the roulette section of the ball lottery apparatus to the ball-through status.

In the above-described embodiment, in order to switch the roulette section 53 from the ball-hold status to the ball-through status, the host controller 40 controls the slide motor unit 54, whereby the retention plate 52 is revolved clockwise with respect to the roulette wheel 51. However, the manner for switching from the ball-hold status to the ball-through status is not limited to the embodiment. For example, the host controller 40 may control the slide motor unit 54, whereby the retention plate 52 is revolved counterclockwise with respect to the roulette wheel 51 to switch the roulette section 53 from the ball-hold status to the ball-through status. FIG. 12 is a plan view showing the roulette section 53 switched to the ball-through status in this manner. As will be understood from FIG. 12, the angular position of the retention plate 52 is controlled so that the holes H and the lottery pockets P are superposed. In this variation of FIG. 12, the position of the sliding member 96 at this stage is near an end E2 of the elongated hole 98 in its longitudinal direction that is opposite to the above-mentioned end E1. The position of the sliding member 96 at this time is referred to as a "third position".

In order to rotate the retention plate 52 counterclockwise with respect to the roulette wheel 51 for switching the roulette section 53 from the ball-hold status to the ball-through status, the host controller 40 controls the slide motor unit 54 to move the sliding member 96 from the first position to the third position. On the other hand, in order to switch the roulette section 53 from the status shown in FIG. 12 to the ball-hold status again, the host controller 40 controls the slide motor unit 54 to move the sliding member 96 from the third position to the first position.

| REFERENCE SYMBOLS | |
|---|---|
| 10: Ball Lottery Apparatus | 20: Stations |
| 30: Display Unit | |
| 40: Host Controller (Driver, Mode Selector, Rotation Controller, Lottery Controller, Game Execution Controller) | |
| 50: Lottery Mechanism | 51: Roulette Wheel |
| 52: Retention Plate | 53: Roulette Section |
| 54: Slide Motor Unit (Driver) | 55: Rotation Mechanism |
| 56: Shaft | 57: Motor Unit |
| 58: Timing Belt | 60: First Reservoir (Ball Input) |
| 61: First Discharger (Ball Input) | 62: First Rail |
| 63: Second Reservoir (Ball Input) | |
| 64: Second Discharger (Ball Input) | |
| 65: Second Rail | 70: Retrieval Mechanism |
| 71: Main Body | |
| 72: First Retrieving Duct (First Retrieving Section) | |
| 73: Second Retrieving Duct (Second Retrieving Section) | |
| 74: Confluence Section | |
| 75a: First Sloping Surface (First Retrieving Section) | |
| 75b: Second Sloping Surface (Second Retrieving Section) | |
| 76: Route Switcher | 77a: First Conveyor |
| 77b: Second Conveyor | 80: Carrier Mechanism |
| 81: First Partition Line | 82: Second Partition Line |
| 90: Connection Member | 92: Slide Motor |
| 94: Screw Shaft | 96: Sliding Member |
| 100: Game Apparatus | 150: Field |
| 1b: Lottery Ball | F: Rib (Retaining Member) |
| F': Rib (Retaining Member) | H, H2: Hole |
| H': Space | L1: First Retrieving Line |
| L2: Second Retrieving Line | N: Cutout |
| Ph: Through-Hole | |

The invention claimed is:

1. A ball lottery apparatus comprising:

a roulette section comprising:

a roulette wheel having multiple lottery pockets through which lottery balls can pass, the lottery pockets being arranged along a circumferential direction; and a retention plate located below the roulette wheel, comprising multiple retaining members configured to coincide with the lottery pockets, respectively, for retaining the lottery balls that have entered the lottery pockets without falling, and spaces interposed between neighboring retaining members, the lottery balls being capable of passing through the spaces, the roulette wheel and the retaining members configured to be rotated as a unit;

a driver configured to change a relative position of the retention plate with respect to the roulette wheel;

a mode selector adapted for selecting either of a first mode or a second mode for the roulette section;

a first retrieving section for retrieving lottery balls that have fallen from the lottery pockets at a first area that is a half area of the roulette wheel;

a second retrieving section for retrieving lottery balls that have fallen from the lottery pockets at a second area that is another half area of the roulette wheel;

a rotation controller adapted for controlling rotation of the roulette section; and a lottery controller adapted for deciding a lottery result depending on which lottery pockets the lottery balls have entered, wherein in case in which the mode selector has selected the first mode, the driver sets the position of the retention plate with respect to the roulette wheel so that the retaining members of the retention plate and the lottery pockets of the roulette wheel are superposed, whereby lottery balls that have entered the lottery pockets are retained by the retaining members below the lottery pockets, and wherein in case in which the mode selector has selected the second mode, the driver sets the position of the retention plate with respect to the roulette wheel so that the spaces between the retaining members of the retention plate and the lottery pockets of the roulette wheel are superposed, whereby lottery balls that have entered the lottery pockets fall through the spaces below the lottery pockets, wherein in case in which the lottery controller executes a lottery, the mode selector selects the first mode, and the rotation controller rotates the roulette section, and wherein after the lottery controller decides the lottery result, the mode selector selects the second mode at a time point at which the difference between a total number of lottery balls entering the lottery pockets in the first area and a total number of lottery balls entering the lottery pockets in the second area is minimum.

2. The ball lottery apparatus according to claim 1, wherein multiple holes through which the lottery balls can pass are formed as the spaces at the retention plate, and are arranged along a circumferential direction, the number of the holes being the same as the number of the lottery pockets, wherein in case in which the mode selector selected the first mode, the driver sets the position of the retention plate with respect to the roulette wheel so that the retaining members of the retention plate interposed between neighboring holes and the lottery pockets of the roulette wheel are superposed, whereby lottery balls that have entered the lottery pockets are retained by the retaining members below the lottery pockets without falling, and wherein in case in which the mode selector has selected the second mode, the driver sets the position of the retention plate with respect to the roulette wheel so that the holes and the lottery pockets of the roulette wheel are superposed, whereby lottery balls that have entered the lottery pockets fall through the holes below the lottery pockets.

3. The ball lottery apparatus according to claim 1, wherein the rotation controller stops the roulette section at the time point.

4. The ball lottery apparatus according to claim 1, further comprising:

a confluence section where the lottery balls retrieved by the first retrieving section and the lottery balls retrieved by the second retrieving section meet;

a ball input configured to input the lottery balls to the roulette section; and a carrier mechanism configured to carry the lottery balls forwarded from the confluence section to the ball input, wherein the lottery balls retrieved by the first retrieving section are forwarded to the confluence section through a first retrieving line that extends from the first retrieving section to an entrance of the confluence section, and wherein the lottery balls retrieved by the second retrieving section are forwarded to the confluence section through a second retrieving line that extends from the second retrieving section to the entrance of the confluence section.

5. A game apparatus comprising:

a roulette section comprising;

a roulette wheel having multiple lottery pockets through which lottery balls can pass, the lottery pockets being arranged along a circumferential direction; and a retention plate located below the roulette wheel, comprising multiple retaining members configured to coincide with the lottery pockets, respectively, for retaining the lottery balls that have entered the lottery pockets without falling, and spaces interposed between neighboring retaining members, the lottery balls being capable of passing through the spaces, the roulette wheel and the retaining members configured to be rotated as a unit;

a driver configured to change a relative position of the retention plate with respect to the roulette wheel; and a mode selector adapted for selecting either of a first mode or a second mode for the roulette section, wherein in a case in which the mode selector has selected the first mode the driver sets the position of the retention plate with respect to the roulette wheel so that the retaining members of the retention plate and the lottery pockets of the roulette wheel are superposed, whereby lottery balls that have entered the lottery pockets are retained by the retaining members below the lottery pockets, and wherein in a case in which the mode selector has selected the second mode, the driver sets the position of the retention plate with respect to the roulette wheel so that the spaces between the retaining members of the retention plate and the lottery pockets of the roulette wheel are superposed, whereby lottery balls that have entered the lottery pockets fall through the spaces below the lottery pockets; and a game execution controller adapted to execute a first game in which a lottery result obtained in case in which the mode selector has selected the first mode is utilized, and to execute a second game in which a lottery result obtained in case in which the mode selector has selected the second mode is utilized.

6. The game apparatus according to claim 5, wherein a total number of the lottery balls used in a single lottery is less than a total number of the lottery pockets in the first game, and wherein a total number of the lottery balls used in a single lottery is greater than a total number of the lottery pockets in the second game.

7. The game apparatus according to claim 6, wherein each single lottery pocket accepts and retains at most one lottery ball in the first game, and wherein multiple lottery balls can pass through any of the lottery pockets in the second game.

8. The game apparatus according to claim 5, wherein each single lottery pocket accepts and retains at most one lottery ball in the first game, and wherein multiple lottery balls can pass through any of the lottery pockets in the second game.

* * * * *